US005704820A

United States Patent [19]

Chandross et al.

[11] Patent Number: 5,704,820

[45] Date of Patent: Jan. 6, 1998

[54] METHOD FOR MAKING IMPROVED PILLAR STRUCTURE FOR FIELD EMISSION DEVICES

[75] Inventors: Edwin Arthur Chandross, Murray Hill; Sungho Jin, Millington; Gregory Peter Kochanski, Dunellen; John Thomson, Jr., Spring Lake; Wei Zhu, North Plainfield, all of N.J.

[73] Assignee: Lucent Technologies Inc., Murray Hill, N.J.

[21] Appl. No.: 381,377

[22] Filed: Jan. 31, 1995

[51] Int. Cl.[6] ..... H01J 1/88

[52] U.S. Cl. ..... 445/24

[58] Field of Search ..... 445/24, 25; 313/309

[56] References Cited

U.S. PATENT DOCUMENTS

| | | | |
|---|---|---|---|
| 5,007,872 | 4/1991 | Tang | 445/25 |
| 5,504,385 | 4/1996 | Jin et al. | 445/24 |
| 5,561,340 | 10/1996 | Jin et al. | 313/309 |

*Primary Examiner*—Kenneth J. Ramsey
*Attorney, Agent, or Firm*—Glen E. Books

[57] ABSTRACT

The pillar structure according to the invention has a substantially longer surface path length from negative to positive electrodes resist breakdown in a high voltage environment. The processing and assembly methods in this invention permit low-cost manufacturing of high breakdown-voltage, dielectric pillars for the flat panel display.

3 Claims, 2 Drawing Sheets

METHOD FOR MAKING IMPROVED PILLAR STRUCTURE FOR FIELD EMISSION DEVICES

FIELD OF THE INVENTION

This invention pertains to field emission devices and, in particular, to methods for preparing an improved pillar structure for such devices using a multi-layer material configuration.

BACKGROUND OF THE INVENTION

Field emission of electrons into vacuum from suitable cathode materials is currently the most promising source of electrons in vacuum devices. These devices include flat panel displays, klystrons and traveling wave tubes used in microwave power amplifiers, ion guns, electron beam lithography, high energy accelerators, free electron lasers, and electron microscopes and microprobes. The most promising application is the use of field emitters in thin matrix-addressed flat panel displays. See, for example, J. A. Costellano, *Handbook of Display Technology* Academic Press, New York, pp. 254 (1992), which is incorporated herein by reference. Diamond is a desirable material for field emitters because of its low-voltage emission characteristics and its robust mechanical and chemical properties. Field emission devices employing diamond field emitters are disclosed, for example, U.S. patent application Ser. No. 08/361616 filed by Jin et al. Dec. 22, 1994. This application is incorporated herein by reference.

A typical field emission device comprises a cathode including a plurality of field emitter tips and an anode spaced from the cathode. A voltage applied between the anode and cathode induces the emission of electrons towards the anode.

A conventional electron field emission flat panel display comprises a flat vacuum cell having a matrix array of microscopic field emitters formed on a cathode of the cell (the back plate) and a phosphor coated anode on a transparent front plate. Between cathode and anode is a conductive element called a grid or gate. The cathodes and gates are typically intersecting strips (usually perpendicular strips) whose intersections define pixels for the display. A given pixel is activated by applying voltage between the cathode conductor strip and the gate conductor. A more positive voltage is applied to the anode in order to impart a relatively high energy (400–3,000 eV) to the emitted electrons. See, for example, U.S. Pat. Nos. 4,940,916; 5,129,850; 5,138,237 and 5,283,500, each of which is incorporated herein by reference.

The anode layer is mechanically supported and electrically separated from the cathode by pillars placed sparsely so as not to drastically reduce the field emission areas of the display. In order to withstand the high voltage applied to the anode for phosphor excitation, the pillar material should be dielectric and should have high breakdown voltage.

One of the limiting factors in the display performance in the flat panel, field emission display (FED) is the allowable maximum operating voltage between emitter (cathode) and anode. The measured efficiency for typical ZnS-based phosphor, (e.g. the P22 red, green, and blue, as commercially available from GTE) increases approximately as the square-root of the voltage over a wide voltage range, so a field emission display should be operated at as high a voltage as possible to obtain maximum efficiency. This is especially important for portable, battery-operated devices in which low power consumption is desirable. The applicants have also found that the electron dose that phosphors can survive without substantial degradation of their luminous output similarly increases with operating voltage. It is not generally recognized that the combination of these two effects makes it especially advantageous to operate at high voltage. The display needs to produce the same light output, irrespective of its operating voltage. Since the efficiency improves at high voltage, less total power must be deposited on the anode. Further, since the power is the anode voltage times the current, the current required to maintain a constant light output decreases even faster than the power. When this is combined with the above-mentioned increase in dose required to damage the phosphor, the lifetime is found to be a strongly increasing function of the voltage. For a typical phosphor, we anticipate that changing the operating voltage from 500V to 5000V would increase the device's operating lifetime by a factor of 100.

Most practical field emission displays require integrated dielectric pillars to keep the substrate and screen separated. Without these pillars, the pressure difference between a normal atmosphere outside and vacuum inside will flex the anode and the cathode surfaces together. The pillars would be typically 100–1000 μm high, and would support the area of typically 1000–100,000 pixels. Because of the insulator breakdown in high electrical fields, these pillars put limitations on the voltage that can be applied to the display, and consequently limit the phosphor efficiency and thus the power consumption. The voltage limitation arises because it is necessary to avoid electric discharges along the surface of the pillars.

There is a substantial amount of knowledge on surface breakdown on insulators in vacuum, see a review paper by R. Hawley, Vacuum, vol. 18, p. 383 (1968). For insulator surfaces oriented parallel to the electric field, typical electric fields at which breakdown occurs seem to be no better than $10^4$ V/cm (e.g., 5000 V across a 5 mm gap). This is dramatically lower than the $1–10\times10^6$ V/cm that most solids will support through the bulk. Smaller dielectric objects will support larger electric fields, for example, 200 μm high pillars will typically support about 2–5×104 V/cm, but the overall voltage (which is field times height) is still a monotonic function of height.

Since Field Emission displays with ZnS-based phosphors are desirably operated at 2000V or more (even more desirably at 4000V or more), a straight-walled pillar would have to be 0.5 mm–1 mm tall (allowing for a safety factor of 1.5). Such tall pillars lead to difficulties in keeping the electrons focussed as they travel between emitter and the phosphor screen. The applicants are not aware of any literature that discusses the effects of electron bombardment on dielectric breakdown, but it seems likely that it will decrease the breakdown voltages further, and thus require yet taller pillars.

If we consider an insulating surface in a vacuum containing a few electrons, the insulator surface will generally become charged. The sign of the charge is not necessarily negative. Incoming electrons can knock electrons off the insulator, a process known as secondary emission. If, on average, there is more than one outgoing electron per incoming electron, the insulator will actually charge positively. The positive charge can then attract more electrons. This process doesn't run away on an isolated block of insulator, because the positive charge eventually prevents the secondary electrons from leaving, and the system reaches equilibrium.

However, if we put the insulator between two electrodes and establish a continuous voltage gradient across the insulator, the secondary electrons can always hop toward the more positive electrode. One can get a runaway process where most of the insulator becomes positively charged (to a potential near that of the most positive electrode) so that the voltage gradients near the negative electrode becomes very strong. These stronger gradients can lead to field emission from the negative electrode, and another cycle of charging and emission. This process can lead to the formation of an arc across the surface long before the insulator would break down through the bulk.

Accordingly there is a need for novel and convenient methods for producing and assembling a pillar structure with desirable geometrical configurations and dielectric properties.

SUMMARY OF THE INVENTION

The pillar structure according to the invention has a substantially longer surface path length from negative to positive electrodes to resist breakdown in a high voltage environment. The processing and assembly methods in this invention permit low-cost manufacturing of high breakdown-voltage, dielectric pillars for the flat panel display.

BRIEF DESCRIPTION OF THE DRAWING

The nature, advantages and various additional features of the invention will appear more fully upon consideration of the illustrative embodiments now to be described in detail in connection with the accompanying drawings. In the drawings.

Figure 1:
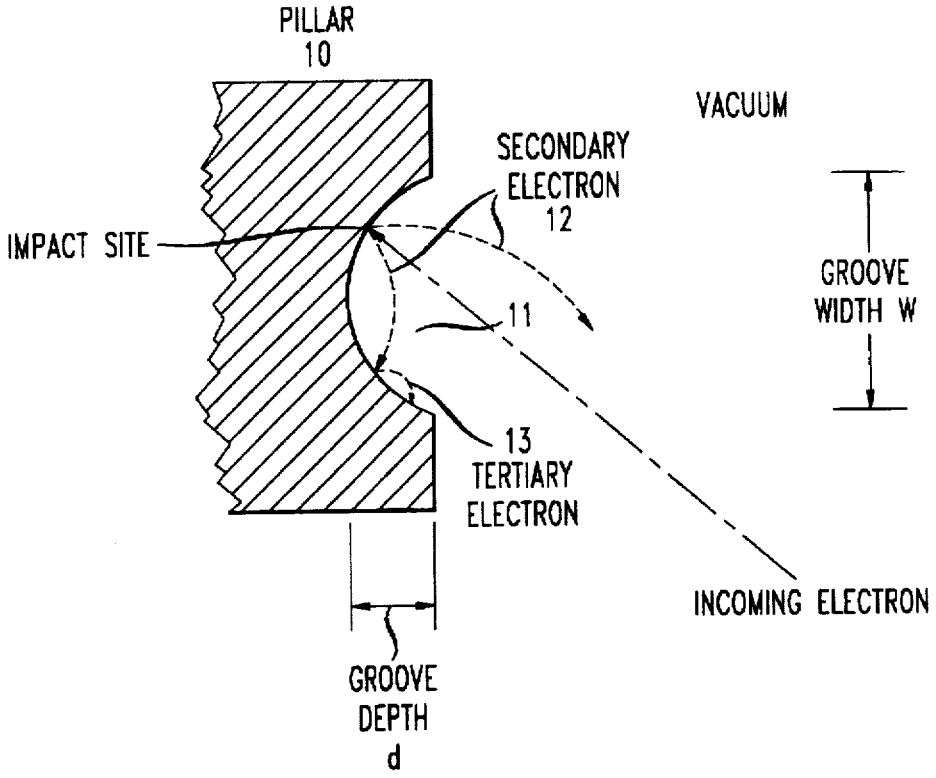
FIG. 1 is a drawing describing the relationship between material properties and allowable geometry of the pillar.

It is to be understood that the drawings are for purposes of illustrating the concepts of invention and are not to scale.

DETAILED DESCRIPTION

The pillars in the field emission flat panel displays mechanically support the anode layer above the pillars, and electrically separate the cathode and anode. Therefore, mechanical strength as well as dielectric properties of the pillar material are important. In order to withstand the high electrical field applied to operate the phosphor material which is typically coated on the anode plate, the pillar material should be an electrical insulator with high breakdown voltage, e.g. greater than about 2000 V and preferably greater than 4000 V for using the established phosphors such as the ZnS:Cu,Al phosphor.

First, the optimal pillar design is one where surface paths from negative to positive electrodes are as long as possible, while keeping the height of the pillar short.

Second, it is desirable to construct the pillar so that most secondary electrons will re-impact the pillar surface close to the point of their generation, rather than being accelerated a substantial distance toward the positive electrode. This goal is advantageous because most materials generate less than one secondary electron for each incident electron if the incident energy is less than 500V (or more preferably, less than 200V). Under these conditions, secondary electrons will generally not have enough energy to make an increasing number of secondaries of their own. For the purposes of this goal, "close" is defined as "a point where the electrostatic potential is less than 500V more positive than the point at which the electron is generated, and preferably less than 200V more positive."

Third, it is desirable to have as much of the surface of the pillar oriented so that the local electric field is nearly normal to the insulator surface, preferably with the field lines emerging from the surface, so that secondary electrons will be pulled back toward the surface and re-impact with energies less than the abovementioned 200–500V. It is known that a conical pillar that has the electric field coming out of the insulator surface at 45 degrees from the normal can hold off as much as four times the voltage that a pillar with walls parallel to the field will support.

Fourth, the pillar must not be so much wider at the anode end so that it substantially reduces the area that can be allocated to the phosphor screen.

A suitable pillar material according to the invention may be chosen from glasses such as lime glass, Pyrex, fused quartz, ceramic materials such as oxide, nitride, oxynitride, carbide (e.g., $Al_2O_3$, $TiO_2$, $ZrO_2$, AlN) or their mixture, polymers (e.g., polyimide resin) or composites of ceramics, polymers, or metals. The preferred pillar material is 70 wt % portland cement, 30% alumina, though other castable refractory ceramics are appropriate (ORPAC castable ceramic pastes). A typical geometry of the pillar in this invention is a modified form of either a round or rectangular rod. A cylinder, plate, or other irregular shapes can also be used as a basis of this invention. The diameter of the pillar is typically 50–1000 μm, and preferably 100–300 μm. The height-to-diameter aspect ratio of the pillar is typically in the range of 1–10, preferably in the range of 2–5. The desired number or density of the pillars is dependent on various factors to be considered. For sufficient mechanical support of the anode plate, a larger number of pillars is desirable. However, in order to minimize the loss of display quality, manufacturing costs and risk of electrical breakdown, too many pillars are not desirable, and hence, some compromise is necessary. A typical density of the pillar in this invention is about 0.01–2% of the total display surface area, and preferably 0.05–0.5%. For a FED display of about 25×25 cm area, approximately 500–2000 pillars each with a cross-sectional area of 100×100 μm is a good example of the pillar structure.

Since the breakdown of the dielectric properties in the pillar occurs most frequently at its surface, it is desirable to increase the surface length of the pillar between the cathode and the anode. In this invention, the surface length is increased by introducing essentially a circumferentially undulating surface structure in the pillar material through novel processing. This structure also traps many secondary electrons, and thus further improves the breakdown voltage.

In these pillar designs, there is an allowable tradeoff between the material properties (i.e. $\delta_{max}$ and the conductivity) and the geometry of the pillars. In order to reduce the undesirable multiplication of electrons, it is desirable that the average number of secondary electrons that are generated by an incident electron and then travel through enough of a potential drop to generate more than one tertiary electron be less than unity. We define a tertiary electron as another secondary electron produced from a initial secondary electron that has been accelerated into a surface. The former secondary electron typically must have 200–1000 eV of energy on impact with the surface in order to generate more than one tertiary electron. This threshold energy is referred to as $E_o$, and is available in standard tables for each material.

As shown in FIG. 1, which illustrates a pillar 10 having a groove 11 not all secondary electrons 12 will travel far enough to have gained more energy than $E_o$ so that they will make more than one tertiary electron 13. Surfaces with deep grooves (where the depth of the groove d is greater than 0.3 times the width, are preferred, and surfaces where the groove depth is greater than the width are especially preferred, because a large fraction of secondary electrons collide with the surface before they have acquired much energy. Consequently, materials with higher $\delta_{max}$ require grooves with a greater ratio of d/w. Also as will be apparent from FIG. 1, the voltage difference across a groove must be smaller than $E_o/q$ (q is the electron charge), for the above argument to hold. Consequently, the desired number of grooves along the length of the pillar according to the invention, is typically greater than $Vq/E_o$, and preferably greater than $2Vq/E_o$. Thus, pillars with large $E_o$ require fewer grooves.

Figure 2:
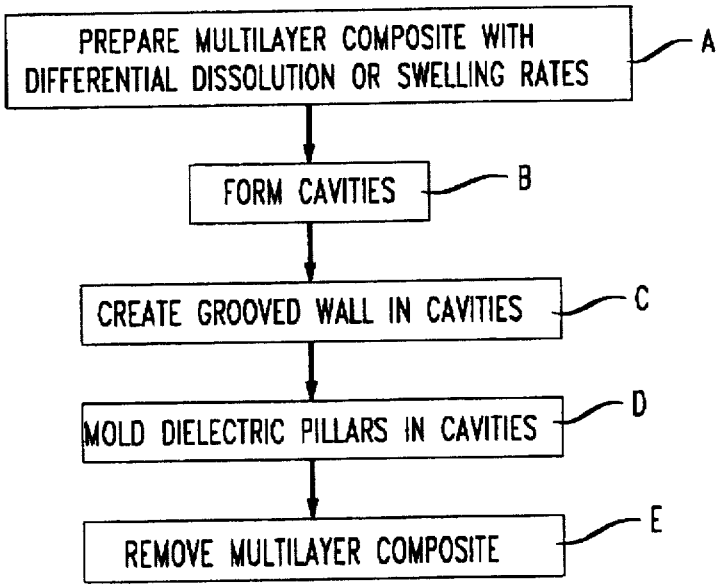
FIG. 2 is a block diagram of the steps in a method of making an improved pillar structure using a multilayer matrix.
Figure 3A:
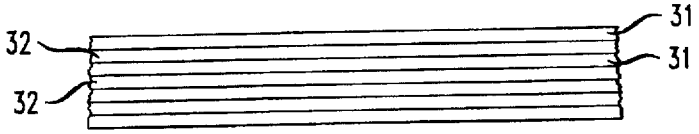
FIG. 3 (schematically illustrates the steps in FIG. 2 with cross-sectional diagrams.

Referring to FIG. 2, sequential steps in the method of preparing grooved pillars using a multi-layer configuration are described. The first step (block A in FIG. 2), is preparation of a disposable multi-layer composite consisting of two or more materials with differential dissolution rate in acid, alkali, or solvent, or with differential a degree of swelling in the presence of solvent. The two or more different materials are stacked in an alternating sequence. Well-known dispensing techniques such as spray coating, spin coating, doctor blading can be used for constructing a multi-layer polymer composite. FIG. 3A shows the resulting structure 30 with different layers 31 and 32.

The preferred embodiment to obtain a multilayer is co-extrusion from the melt, with lay up of several co-extruded sheets as necessary to reach the desired thickness. Co-extrusion is a well established technique in the food packaging industry. The co-extruded polymers must be matched in melt flow properties, typically by choice of materials and by adjusting the distribution of molecular weights.

Alternatively, alternate layers of the polymer could be sprayed or roll-coated onto films of the other layers, then the resulting bilayer sheets can be pressed together to make the final multilayer film. This multilayer film can be adhered onto the emitter structure, e.g., by heating the assembly to 50°–150° C. for improved adhesion. The film according to the invention is typically about 0.1–2.0 mm thick, and preferably 0.3–1.0 mm thick. Yet another alternative is to directly deposit the multilayers onto the substrate by spin-coating or spray-coating of the two or more polymer precursor liquids with intermediate or final drying/solidification/polymerization steps. The polymers are chosen to have solubilities (in a suitable etchant) or swelling rates alternatively above and below a smoothly nondecreasing curve. Polymer layers closer to the substrate are exposed to the etchant (solvent) for less time, so they preferably etch)swell) more rapidly so that the final etched hole has dimensions near the substrate similar to its dimensions near the free surface.

Figure 3B:
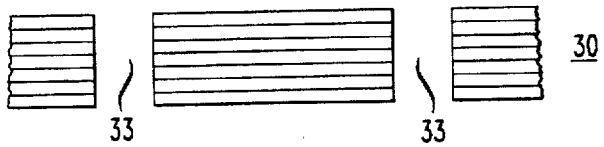

The next step in FIG. 2 (block B) is to make vertical cavities, in the multi-layer composite sheet. The cavities having the size of the desired pillar dimension, are either cut out, punched out, or embossed mechanically, or thermally cut out (e.g., by excimer laser ablation), or chemically etched out (e.g., photolithographically or by using differentially photo-sensitive polymers as the components in the multilayer composite). The preferred method is mechanical embossing. FIG. 3B shows a multilayer composite 30 with cavities 33 after an embossing tool penetrated the film. Typical depths are 90%–99%, preferably 97%–99%.

Figure 3C:
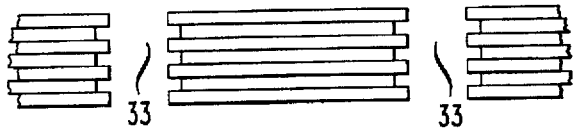

The next step in FIG. 2 (block C) is then to create a grooved wall in the cavities, as schematically illustrated in FIG. 3C (cavities 33) by utilizing the differential etch rate or differential swelling of the two materials in the multilayer structure. In a typical example, the alternate layers are poly(methyl methacrylate) and a novolac resin, or any other resin containing acidic functional groups. Such resin can be typically etched in aqueous alkali solutions. One skilled in the art can choose appropriate functional groups, functional group densities, and molecular weight distributions to tailor the etch rates to the desired values. Alternatively, polymers with amine functional groups can be alternated with the poly(methyl methacrylate), then etched in aqueous acid. A second alternate would utilize polystyrene, which may be controllably swollen by application of methylated benzene compounds or similar low vapor presume solvents. An oxygen plasma exposure may be briefly used to clean the surface to improve adhesion of the pillars.

Figure 3D:
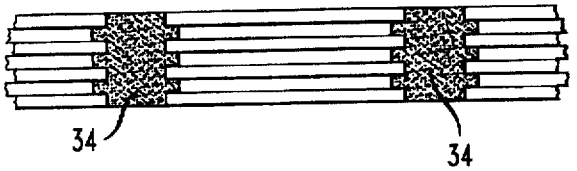
Figure 3E:
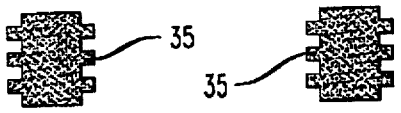

As a next step (block D in FIG. 2), the grooved cavity is then filled with dielectric material (e.g., glass or cement slurry. The structure is illustrated in FIG. 3D with castables 34 in place. The process may be repeated if necessary to completely fill the cavities with the dielectric pillar material.

The next step in FIG. 2 (block E) is to remove the matrix multilayer composite material to free the cast grooved pillars 35. Preferably, solvents may be used to dissolve the multilayer although controlled pyrolysis and/or oxidation may be used if the substrate is compatible, though aqueous etchants are contemplated.

Figure 4:
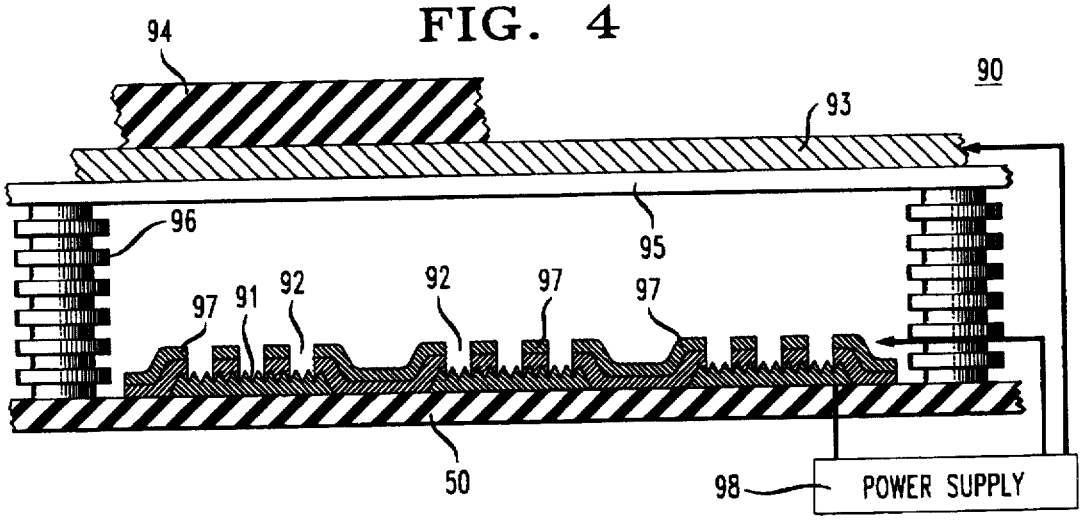
FIG. 4 is a schematic diagram of a field emission flat panel display device employing the pillars of this invention.

The process illustrated by FIGS. 2 and 4 can be applied to either a free-standing composite layer matrix or to a composite matrix adhered to the display substrate. If it is carried out as a free standing composite, the resultant pillars maybe picked and placed on the display substrate, preferably in a simultaneous manner (all pillars together) or partly simultaneous manner (e.g., one row at a time) using vacuum suction template, tacky template, or multi-pronged robotic pick-and-place apparatus. We anticipate that it will be necessary to adjust the size of free-standing films by tensioning under computer control to improve the registration between the pillars and the desired locations on the substrate.

If it is carried out on a composite already placed on the display substrate, care should be taken not to damage other parts such as the conductor coating, (e.g., the gate film or other conductive layers on the display substrate) or the dielectric materials (underneath the gate film) during the heat treatment or chemical etching processes involved.

The preferred use of these grooved pillars is in the fabrication of field emission devices such as electron emission flat panel displays. FIG. 4 is a schematic cross section of an exemplary flat panel display 90 using the high breakdown voltage pillars 96 according to the present invention. The display comprises a cathode 91 including a plurality of emitters 92 and an anode 93 disposed in spaced relation from the emitters within a vacuum seal. The anode conductor 93 formed on a transparent insulating substrate 94 is provided with a phosphor layer 95 and mounted on support pillars 96. Between the cathode and the anode and closely spaced from the emitters is a perforated conductive gate layer 97.

The space between the anode and the emitter is sealed and evacuated, and voltage is applied by power supply 98. The field-emitted electrons from electron emitters 92 are accelerated by the gate electrode 97 from multiple emitters 92 on each pixel and move toward the anode conductive layer 93 (typically transparent conductor such as indium-tin-oxide or a predominantly open grid-like structure, with the phosphor disposed in the open areas of the grid) coated on the anode substrate 94. Phosphor layer 95 is disposed between the electron emitters and the anode. As the accelerated electrons hit the phosphor, a display image is generated.

It is to be understood that the above-described embodiments are illustrative of only a few of the many possible specific embodiments which can represent applications of the principles of the invention. For example, the high breakdown voltage pillars of this invention can be used not only for flat-panel display apparatus but for other applications, such as a x-y matrix addressable electron sources for electron lithography or for microwave power amplifier tubes. Thus numerous and varied other arrangements can be made by those skilled in the art without departing from the spirit and scope of the invention.

We claim:

1. A method for making an electron field emission device comprising an emitter cathode electrode, a anode electrode and a plurality of insulating pillars for separating said electrodes, comprising the steps of:

providing said electrodes;

forming a mold having grooved wall cavities;

molding dielectric pillars in said cavities, said pillars having grooved outer surfaces;

adhering said pillars to one of said electrodes; and finishing said device.

2. The method of claim 1 wherein said mold is formed by preparing a multilayer composite with layers having different dissolution rates, forming holes in said composite, and etching said composite.

3. The method of claim 1 wherein said mold is formed by preparing a multilayer composite with layers having different solvent swelling rates, forming holes in said composite, and subjecting said composite to solvent.

* * * * *